United States Patent [19]

Krauss

[11] 4,356,978

[45] Nov. 2, 1982

[54] FUEL INJECTION VALVE AND A METHOD FOR MANUFACTURING A FUEL INJECTION VALVE

[75] Inventor: Rudolf Krauss, Stuttgart, Fed. Rep. of Germany

[73] Assignee: Robert Bosch GmbH, Stuttgart, Fed. Rep. of Germany

[21] Appl. No.: 184,507

[22] Filed: Sep. 5, 1980

[30] Foreign Application Priority Data

Sep. 8, 1979 [DE] Fed. Rep. of Germany ..... 2936332

[51] Int. Cl.[3] ..... B05B 1/32

[52] U.S. Cl. ..... 239/533.12; 239/453

[58] Field of Search ..... 239/533.12, 456, 459, 239/453, 452, 533.2–533.11, 533.13, 533.14; 267/161; 251/174

[56] References Cited

U.S. PATENT DOCUMENTS 3,690,566 9/1972 Krauss et al. ..... 239/533.12 X 4,273,309 6/1981 Morrison ..... 267/161 X

*Primary Examiner*—John J. Love

*Assistant Examiner*—Gene A. Church

*Attorney, Agent, or Firm*—Edwin E. Greigg

[57] ABSTRACT

A fuel injection valve and a method for manufacturing the fuel injection valve serving to inject easily vaporized fuels are proposed in which the fuel injection valve includes a closing body that controls the fuel outlet and is subjected to a closing force and a nozzle holder secured on the internal combustion engine or on the suction tube. A nozzle body is displaceable within the nozzle holder against a shaped disc until such time as the closing spring supported in the inner area on the shaped disc has an initial stress which corresponds to the valve opening pressure force.

9 Claims, 2 Drawing Figures

FUEL INJECTION VALVE AND A METHOD FOR MANUFACTURING A FUEL INJECTION VALVE

BACKGROUND OF THE INVENTION

The invention relates to a fuel injection valve serving to inject readily vaporized fuels having a nozzle body displaceable within a nozzle holder against a disc until a point in time as a closing spring supported in an area on the disc has an initial stress which corresponds to a valve opening pressure force. Fuel injection valves and methods for manufacturing it are already known in which the initial setting of the valve opening pressure is effected by varying the force of the closing spring by interposing spacer discs of varying thicknesses as, for example, described in U.S. Pat. No. 3,690,566 issued Sept. 12, 1972 to Krauss et al. Such a procedure hinders automation, is expensive, and involves excessive deviations in the valve opening pressures from one individual fuel injection valve to another.

OBJECT AND SUMMARY OF THE INVENTION

The fuel injection valve according to the invention serving to inject readily vaporized fuels having a nozzle body displaceable within a nozzle holder against a disc until a point in time as a closing spring supported in an area on the disc has an initial stress which corresponds to a valve opening pressure force has the advantage over the prior art that it is easy to manufacture, that it permits automation of the initial setting of the valve opening pressure, and that the deviations in the valve opening pressures among the individual fuel injection valves can be kept within very narrow limits.

By applying the characteristics disclosed herein, advantageous variants of and improvements in the fuel injection valve as disclosed are possible.

The method according to the invention for manufacturing a fuel injection valve as disclosed has the advantage that the initial setting of the valve opening pressure can be done in a cost-favorable manner and very precisely in a single automated procedure.

Advantageous variants of and improvements in the method disclosed in claim 7 can be achieved by the application of the characteristics disclosed in claims 8–10.

The invention will be better understood and further objects and advantages thereof will become more apparent from the ensuing detailed description of a preferred embodiment taken in conjunction with the drawings.

DETAILED DESCRIPTION OF THE PREFERRED EMBODIMENT

Figure 1:
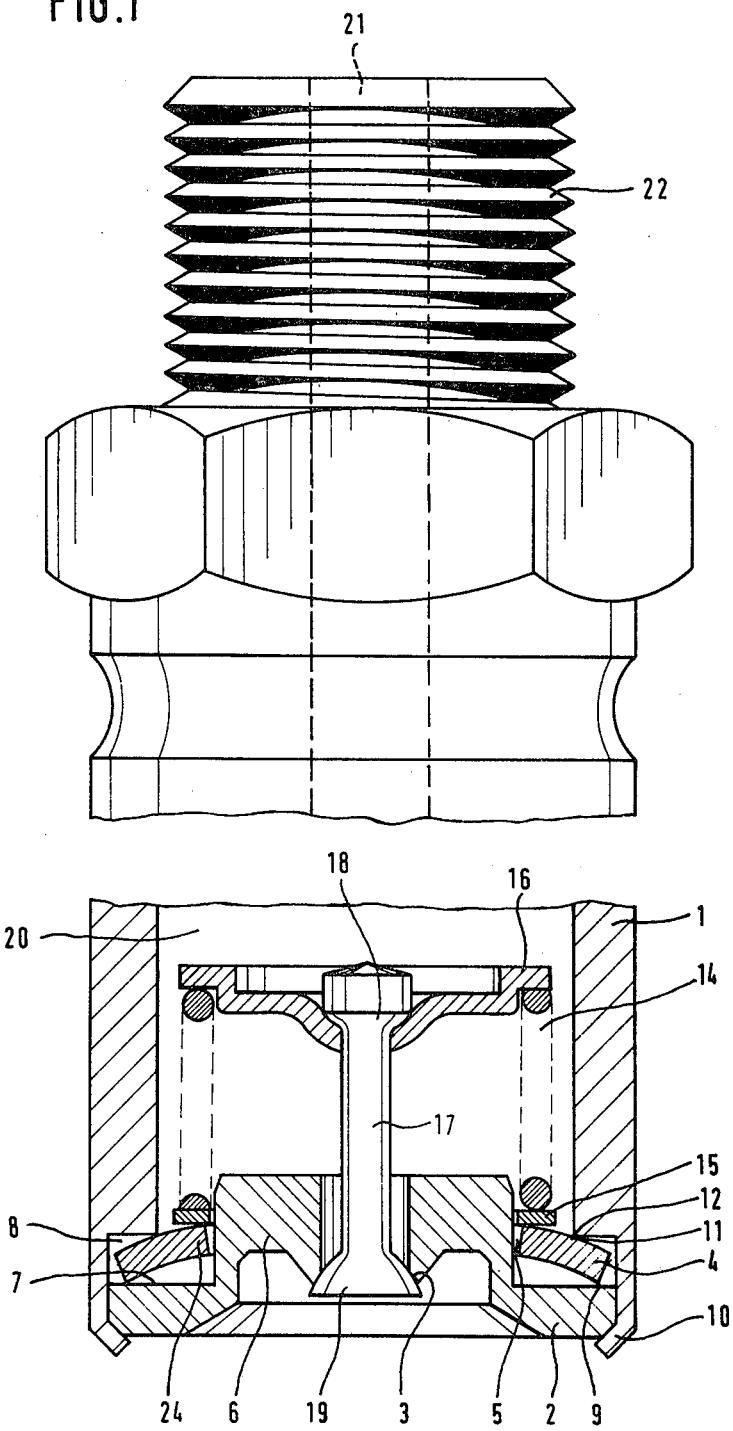
FIGS. 1A and 1B show a fuel injection valve in simplified form in side elevation and cross sectional views.

The fuel injection valve shown in FIGS. 1A and 1B is intended particularly for the injection of fuel into the suction tube of mixture-compressing internal combustion engines with externally supplied ignition. It has a nozzle holder 1, in which a nozzle body 2 is disposed on one end, the nozzle body 2 having an injection port 3 simultaneously acting as a valve seat. A shaped disc 4 is supported on the nozzle body 2 and has a central passageway aperture 5, through which a step 6 of the nozzle body 2 protrudes. The shaped disc 4 is embodied as elastically or plastically deformable and is shaped such that, viewed in the radial direction, the outer and the inner regions of the shaped disc 4 lie in different planes. In the exemplary embodiment of FIG. 1, the outer region of the shaped disc 4 is closer to a contact face 7 of the nozzle body 2 than is the inner region of the shaped disc 4 which includes the passageway aperture 5. The shaped disc 4 shown is curved in circular fashion, by way of example, outside the passageway aperture 5; however, it could also be simply oblique in this area, so that edge surfaces of the disc 4 would be conical elements in embodiment. The shaped disc 4 protrudes into a recess 8 of the nozzle holder 1, in which the nozzle body 2 is guided as well, and it is supported with its outer circumferential edge 9 on the contact face 7 of the nozzle body 2; in a region 11, the shaped disc 4 is pressed against a contact face 12, which defines the recess 8 on the other side, by the nozzle body 2 which is fixed on the nozzle holder 1 by means of a flanged rim 10. A closing spring 14 is supported in the vicinity of the passageway aperture 5 of the shaped disc 4, a disc 15 being interposed if needed, and the other end of the closing spring 14 acts upon a spring plate 16. The spring plate 16 has a spherically embodied central area on which a closing body 17 is suspended via a head 18 which has a spherical section. On its end oriented toward the nozzle body 2, the closing body 17 has a hemispherically embodied closing head 19, which in cooperation with the injection port 3 forms the actual valve. The nozzle body 2, closing spring 14, spring plate 16 and closing body 17 are disposed in a pressure chamber 20 in the nozzle holder 1; the pressure chamber 20 is limited on one end by the nozzle body 2 and on the other end a flow channel 21, indicated by broken lines, discharges into it. The flow channel 21 passes through the nozzle holder 1 lengthwise and communicates on the other end with a fuel inflow line, not shown. The fuel inflow line may be secured by means of a nut to a threaded portion 22 of the nozzle holder 1.

The fuel injection valve embodied in accordance with the invention makes it possible for the edge 9 of the shaped disc 4 to move farther into the recess 8—in other words, for it to be flattened, this being a consequence of the displacement of the nozzle body 2, for instance during flanging by a flanging tool. The result is that because of the support of the shaped disc 4 on the opposite side on the contact face 12, the region 24 of the shaped disc 4, on which the closing spring 14 is supported, moves in the opposite direction—that is, away from the closing spring—so that the closing spring 14 relaxes to a greater extent.

The shaped disc 4 furthermore assumes a sealing function at the edge 9 and at the contact face 12.

Figure 2:
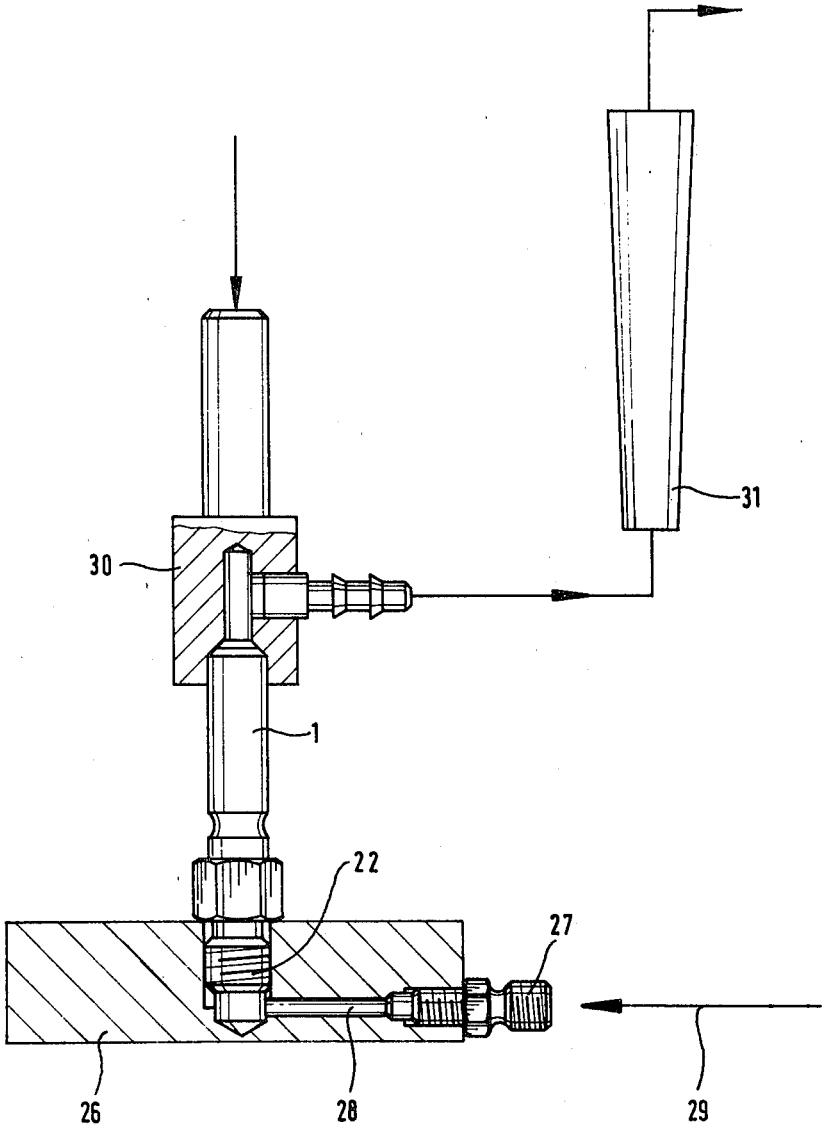
FIG. 2 shows an apparatus in schematic and cross sectional views for performing the method of initial setting of the valve opening pressure for a fuel injection valve according to the invention.

In FIG. 2, an apparatus is shown which is intended for the initial setting of the valve opening pressure of a fuel injection valve as shown in FIG. 1. The nozzle holder 1 of the fuel injection valve is inserted with its threaded portion 22 into a clamping tool 26 and communicates via a pressure connection nozzle 27 and a bore 28 within the clamping tool 26 with a pressure source indicated by the arrow 29. The pressure source 29 delivers a medium, for instance air or fuel, at a constant pressure; in the present instant, this pressure is the desired valve opening pressure. A flanging tool 30 is placed upon the other end of the nozzle holder 1 and with variable, increasing force it flanges the nozzle body 2 to the nozzle holder 1. The outlet 3 of the fuel injection valve contacts a quantity measuring device 31. During the mounting of the fuel injection valve, the force of the closing spring 14 is at first relatively high, because the severely curved shaped disc 4 at first keeps the length of the spring 14 quite short and, at the pressure applied via 29, prevents opening of the valve. With increasing flanging force being exerted by the flanging tool 30, the nozzle body is now pushed into the recess 8 of the nozzle holder 1 and the severity of the curve of the shaped disc 4 is thus reduced more and more, until such time as the fuel injection valve opens at the pressure delivered by the pressure source 29 and representing the valve opening pressure; this is indicated by the quantity measuring device 31. This is caused by the fact that with a displacement of the nozzle body 2 in the direction of the closing spring 14, the region 24 of the shaped disc 4 moved more and more in the direction of the contact face 7 and the closing spring 14 is thus more and more relaxed.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection valve having an axis and comprising a closing body disposed in a nozzle holder and arranged to control a fuel outlet, said closing body being suspended in the manner of a pendulum and arranged to protrude through a nozzle body and cooperate with a valve seat in said nozzle body, said closing body arranged to open in a direction counter to the force of a closing spring supported at one end on a spring plate engaging said closing body, characterized in that said closing spring rests at an opposite end on an elastically deformable shaped disc which is partially braced in an axial direction between the nozzle body and the nozzle holder and is deformed at least partially in the axial direction in such a manner that, viewed in the radial direction, outer and inner regions of the shaped disc lie in different planes, said shaped disc being axially deformable by means of axial displacement of said nozzle body whereby the force of said closing spring is variable.

2. A fuel injection valve as defined by claim 1 characterized in that said closing spring is is supported on said disc inner region and, viewed in the radial direction, the plane in which said disc inner region lies is closer to said closing spring than the plane in which said disc outer region lies.

3. A fuel injection valve as defined by claim 2, characterized in that said shaped disc is provided with means defining a central passageway aperture, and said nozzle body includes a step portion arranged to pass through said disc central passageway aperture.

4. A fuel injection valve as defined by claim 2, characterized in that, viewed in the radial direction, said shaped disc is curved in circular fashion.

5. A fuel injection valve as defined by claim 1, characterized in that said nozzle body is supported in the nozzle holder and is pressed against said shaped disc, partially deforming it, by means of a flange.

6. A method for adjusting the operation of an injection valve having an axis and comprising a closing body disposed in a nozzle holder and arranged to control a fuel outlet, said closing body being suspended in the manner of a pendulum and arranged to protrude through a nozzle body and cooperate with a valve seat in said nozzle body, said closing body arranged to open in a direction counter to the force of a closing spring which is supported at one end on a spring plate engaging said closing body and which is supported at an opposite end on an elastically deformable shaped disc, said disc being partially braced in the axial direction between the nozzle body and the nozzle holder and being deformed at least partially in an axial direction in such a manner that, viewed in the radial direction, outer and inner regions of the shaped disc lie in different planes, wherein said method comprises the step of:

axially displacing the nozzle body in the nozzle holder counter to the force of the shaped disc undergoing deformation until such time as the force of the closing spring corresponds to the desired valve opening pressure force.

7. A method as defined by claim 6, which further comprises:

prior to the step of axially displacing the nozzle body in the nozzle holder, connecting the closed fuel injection valve to a pressure source which delivers a fuel medium at a pressure corresponding to the desired valve opening pressure, whereby in the step of axially displacing the nozzle body in the nozzle holder, the nozzle body is displaced in order to deform the shaped disc until such time as the force of the closing spring corresponds to the valve opening pressure force and opens the fuel injection valve.

8. A method as defined by claim 7, wherein the shaped disc is disposed relative to the nozzle body, the nozzle holder, and the closing spring such that a displacement of the nozzle body in an inward axial direction relative to the nozzle holder causes a reduction in the force of the closing spring, and wherein during the step of axially displacing the nozzle body in the nozzle holder, the nozzle body is displaced in the inward axial direction by means of a flanging tool which creates a flanged rim on the nozzle holder which fixes the nozzle body in the axial direction.

9. A method as defined by claim 8 wherein the outlet of the fuel injection valve is connected with a quantity measuring device which indicates the opening of the fuel injection valve.

* * * * *